US005667439A

United States Patent [19]

Okada

[11] Patent Number: 5,667,439

[45] Date of Patent: Sep. 16, 1997

[54] GAMING MACHINE

[75] Inventor: Kazuo Okada, Tokyo, Japan

[73] Assignee: Universal Sales Co., Ltd., Tokyo, Japan

[21] Appl. No.: 527,549

[22] Filed: Sep. 13, 1995

[30] Foreign Application Priority Data

Sep. 16, 1994 [JP] Japan ..... 6-221480

[51] Int. Cl.[6] ..... G07F 17/34

[52] U.S. Cl. ..... 463/20; 273/143 R

[58] Field of Search ..... 273/143 R; 463/20

[56] References Cited

U.S. PATENT DOCUMENTS 5,083,785 1/1992 Okada ..... 273/143 R

*Primary Examiner*—Benjamin H. Layno
*Attorney, Agent, or Firm*—Rohm & Monsanto

[57] ABSTRACT

A gaming machine comprises a variable display device for variably displaying a plurality of display patterns so as to give a predetermined play value according to the display pattern at the time when variable displays stop, and control unit for driving the variable display device, executing a winning determination and controlling the variable displays of the variable display device to stop so as to be the display patterns of winning or losing according to a result of the determination, when a predetermined play condition is satisfied. The control unit executes desired times of plays when the determination results in a particular winning, and controls the variable displays of the variable display device to stop such that predetermined display patterns are displayed as results of the desired times of plays. Then, the control unit controls the variable displays of the variable display device to stop such that a winning pattern which the player can distinguish as the particular winning is displayed.

3 Claims, 6 Drawing Sheets

| | 1ST COIN | 2ND COIN | 3RD COIN |
|---|---|---|---|
| 7 7 7 | 1000 | 2000 | 8000 |
| 7 7 7 | 500 | 1000 | 1500 |
| BUCKS BUCKS BUCKS | 100 | 200 | 300 |
| | 5 | 10 | 15 |
| | 4 | 8 | 12 |
| | 3 | 6 | 9 |
| | 2 | 4 | 6 |
| BLANK BLANK | 1 | 2 | 3 |

GAMING MACHINE

BACKGROUND OF THE INVENTION

1. Field of the Invention

This invention relates to a gaming machine such as a slot machine, a ball-shooting game machine and the like, which particularly comprises a variable display device for displaying a plurality of display patterns in plays. The display patterns include symbols and combinations of symbols.

2. Prior Art

Referring to a slot machine, for example, a display mechanism which includes a plurality of (usually three) rotating reels disposed in line on front display windows of the slot machine is employed as a variable display device for variably displaying a plurality of display patterns, and a play with such variable displays is executed when a predetermined play condition is satisfied. In this case, the satisfaction of the predetermined play condition is that a player pulls a start lever or pushes a start button. The plurality of rotating reels are started to run by the player's operation and they begin the variable displays by movement of symbols (rows of symbols) as a plural kinds of characters, figures and the like which are indicated on a peripheral surface of each of the rotating reels. Then, a play is over by stopping the variable displays (movement of the rows of symbols) at the timing when the start lever returns (or the timing of pushing a reel stop button if it is provided), or after a predetermined time period has passed.

A control unit accommodated in the slot machine determines whether a play results in winning or not by comparing a value by sampling of a random number with an award table stored in a memory every time one play starts. When the determination results in "winning", the control unit controls the variable displays to stop such that a combination of symbols constructing the display pattern of the "winning" stands on a winning line of the display windows at the time when the variable displays stop, and it gives a predetermined play value (a predetermined number of coins or medals) to the player. On the other hand, when the determination results in "losing", the control unit controls the variable displays to stop such that the combination of symbols constructing the display pattern of the "losing" stands on the line at the time when the variable displays stop.

In such a slot machine, a particular combination of symbols (for example, "7-7-7") called "big winning" which brings the player a big gain (the play value) is predetermined besides usual winning.

Further, some pachinko game machines as a typical ball-shooting game machine employ a rotating reel mechanism that is employed in the slot machine as the variable display device, or electrical display means as LED's (light emitting diode), a LCD (liquid crystal display device), a CRT (cathode ray tube) or the like. In such kind of ball-shooting game machine, a condition of starting a play with the variable displays is that a game ball (pachinko ball) enters into a particular winning hole called "start hole". The variable display device is driven to begin the variable displays (movement of the rows of symbols) according to the satisfaction of the play condition (entering into the start hole), and a winning determination is executed by the random number sampling, then, the variable displays are caused to stop at a predetermined display pattern being based on the result of the determination. Of course, the particular play value is given to the player in the case of winning. Further, the "big winning" may be generated besides the usual winning.

In the gaming machine having such a variable display device as mentioned above, when the player plays the game to make a plurality of symbol combinations completed by the variable displays (this is called "symbol combination game"), he expects the display pattern to be "winning", particularly the "big winning" at the time when the variable displays stop. However, referred to the conventional gaming machines, there is a problem that the player tends to lose an interest in the game, because he can not either recognize or expect when the big winning will occur.

Particularly, referred to a slot machine which has no reel stop button, the player can not operate to aim at the display pattern of the "big winning" by the timing of pushing the stop button, thus the game seems to be simple and the above-mentioned problem becomes greater.

Further, there has been the similar problem referred to a ball-shooting game machine having such a variable display device as above.

SUMMARY OF THE INVENTION

It is an object of the present invention to provide a gaming machine which increases an interest in the game by giving expectation and premonition of winning to a player.

The present invention provides the gaming machine comprising:

a variable display device for variably displaying a plurality of display patterns so as to give a predetermined play value according to the display pattern at the time when variable displays stop; and control means for driving the variable display device, executing a winning determination and controlling the variable displays of the variable display device to stop so as to be the display patterns of winning or losing according to a result of the determination, when a predetermined play condition is satisfied, which is characterized in that the control means executes desired times of plays when the determination results in a particular winning, and controls the variable displays of the variable display device to stop such that predetermined display patterns are displayed as results of those plays, then, the control means controls the variable displays of the variable display device to stop such that a winning pattern which the player can distinguish as the particular winning is displayed.

According to the gaming machine of this invention, when the predetermined play condition is satisfied, the control means drives the variable display device and executes the winning determination, that is, the determination of winning or losing, and controls the variable displays to stop so as to be the display pattern according to the result of the determination. Also, the control means gives the predetermined play value to the player when the determination results in the winning. This function of the control means is similar to conventional machines.

However, when the above determination results in the particular winning (e.g. the "big winning"), the control means executes the desired times of plays by the variable display device and controls the variable displays to stop such that the predetermined display pattern is displayed as the result of each play. Then, after displaying the display patterns for the desired times of plays, the control means controls the variable displays of the variable display device to stop at the winning pattern which can be distinguished as the particular winning.

According to this invention, the player recognizes that such particular winning as the "big winning" will occur after the displays for the desired times of plays are executed, and in fact, when the play of the predetermined display pattern occurs while he is playing the game, he continues playing the game expecting that the particular winning pattern will occur afterward. Therefore, the interest in the gaming machine which accompanies the particular winning accordingly increases more than the prior art.

In a preferred embodiment of the invention, the desired times of plays include a plurality of predetermined symbol combination plays and a symbol combination play which displays the particular winning after the plurality of symbol combination plays are executed.

According to the preferred embodiment, the plurality of predetermined symbol combination plays are executed, and then, the symbol combination play which displays the particular winning is executed. Therefore, when the first symbol combination play occurs, the player expects the following symbol combination plays will occur, and after those symbol combination plays occur, he continues playing the game expecting the particular winning will occur.

In a further preferred embodiment, desired times of losing plays are executed among each of the plurality of symbol combination plays and the symbol combination play which displays the particular winning.

In the further preferred embodiment, since the "losing" plays are executed among the plurality of symbol combination plays, the plays sometimes become against expectation of the player, also the interest in the game becomes greater.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
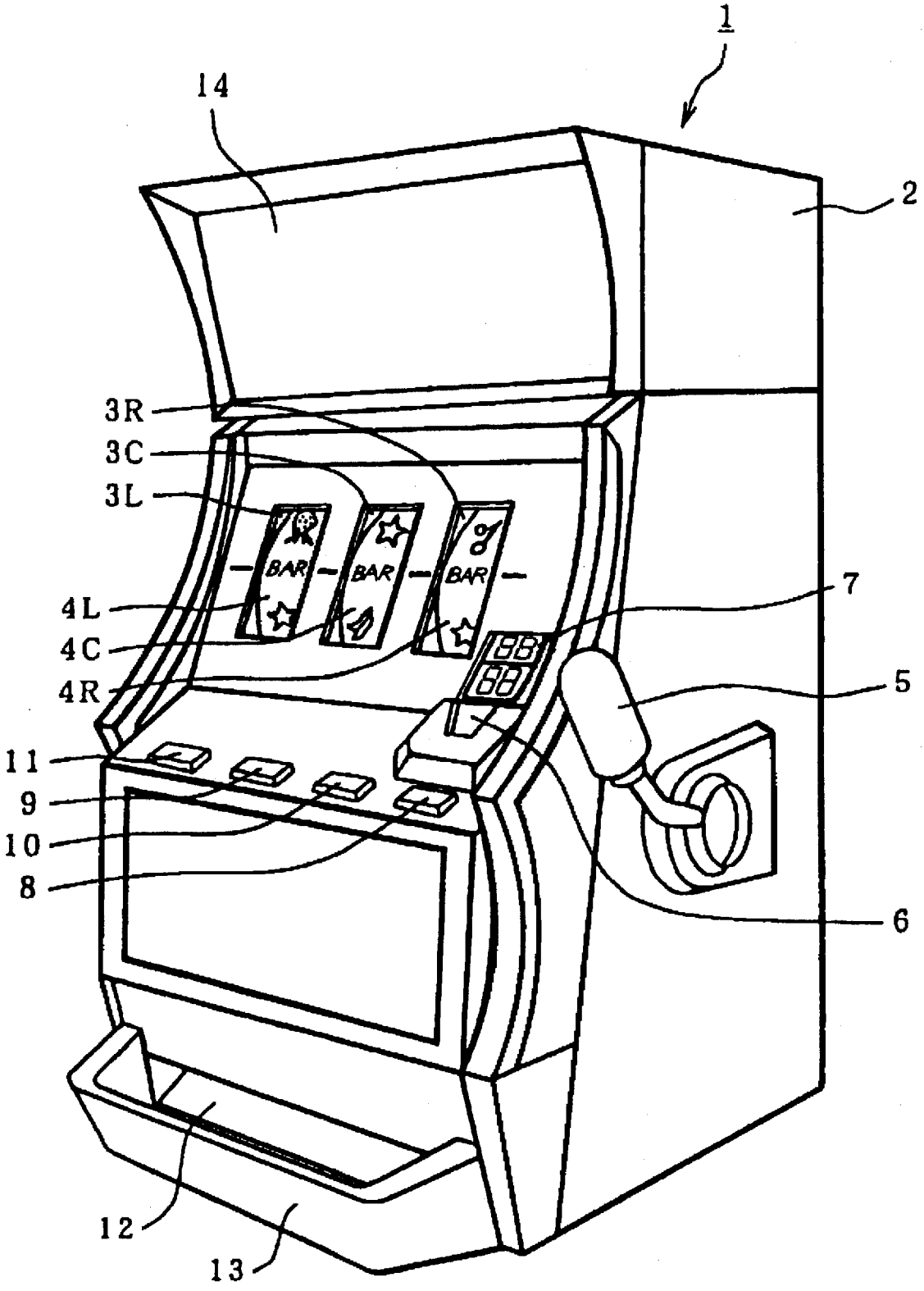
FIG. 1 is a perspective view of the front side of the slot machine of the embodiment.
Figures 5, 6:
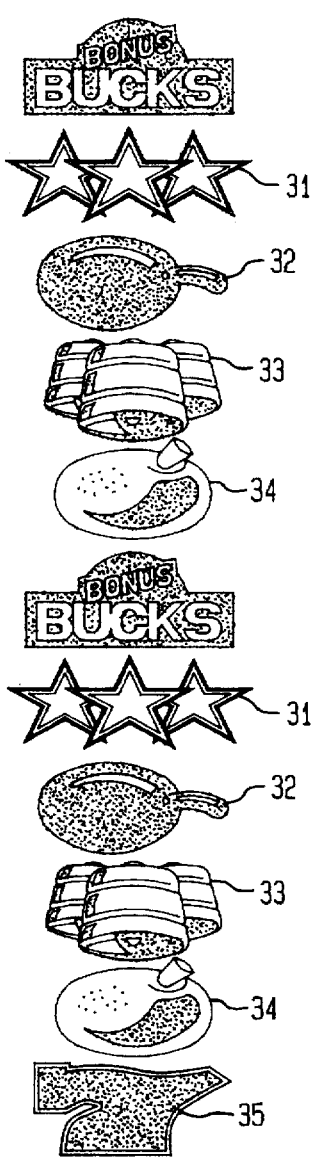
FIG. 5 is a view showing an example of a row of symbols which is displayed on a variable display block of the slot machine.
FIG. 6 is a view showing an example of an award table of the slot machine.

FIG. 1 shows the slot machine of the embodiment of the invention. On the front side of a cabinet 2 which encloses the whole of the slot machine 1, three display windows 3L, 3C and 3R are provided with various kinds of symbols as shown in FIG. 5 displayed at upper, central and lower positions in each display window. These symbols are printed on a sheet forming a peripheral surface of each of three rotating reels 4L, 4C and 4R disposed within the cabinet 2, behind the respective display windows 8L, 8C and 8R. In addition, referring to FIG. 5, "31" indicates stars, "32" indicates a plum, "33" indicates bells, "34" indicates an orange, and "35" indicates a modified figure "7" (which constructs "big winning" symbol combination as described below).

A start lever 5 is provided at a side wall of the cabinet 2 in a manner rotatable through a predetermined range of angle, for permitting the player to operate the reels to start rotating. In addition, a horizontal line LN which ties each center of the display windows 8L, 3C and 3R is a winning line.

At a location below the display windows on the right side of the front of the cabinet 2, there are provided an entry slot 6 for inserting game media such as coins, medals or substitute currency referred as "token" (hereinafter the game media are explained as the coins) and a display block 7 for displaying the number of coins inserted into the machine through the entry slot 6, or the number of coins acquired by the plays, the number of coins deposited as credit at present, etc. The display block 7 is formed by a desired number of 7-segment LED's (four LED's, for example, are capable of designating up to four digits of numeral values). In addition, means for display is not limited to LED's, but may be implemented by LCD (liquid crystal display) elements or the other indicator, as desired.

Below the display windows 8L, 8C and 8R, there are disposed a spin switch 8 for starting to drive the reels into rotation by a button-pushing operation, in stead of operating the start lever 5, a 1-bet switch 9 for betting only one piece of credited coins on a single play by a button-pushing operation, a maximum-bet switch 10 for betting the maximum of coins permitted to bet on a single play by a button-pushing operation, a C/P switch 11 which is operated by a button-pushing operation, for a changeover between the credit and the payout (PLAY CREDIT/PAY OUT) of the coins acquired by the player, and a coin tray 13 for receiving coins paid out via a coin chute 12 at a location below on the front face of the cabinet 2 according to switching the C/P switch 11.

An upper panel 14 on the front face of the cabinet 2 is provided with an award table showing winning symbol combinations and corresponding number of coins paid out as awards. FIG. 6 shows an example of the award table.

Figure 2:
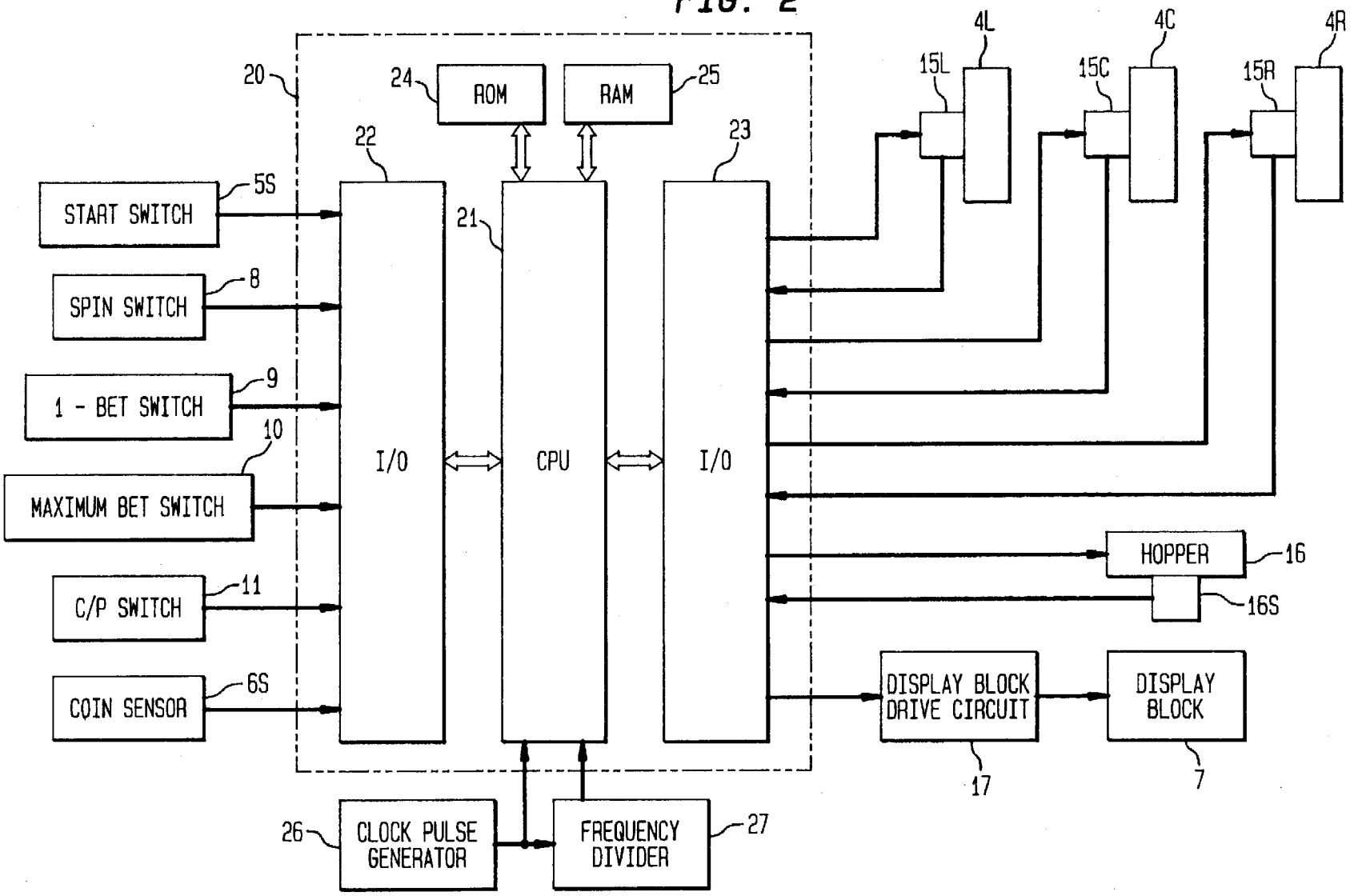
FIG. 2 is a diagram showing the arrangement of the control means of the embodiment.

FIG. 2 shows a control circuit of the embodiment. This control circuit operates under the control of a microcomputer 20 including a CPU 21, I/O ports 22, 23 on an input side and an output side, a RAM 25 and a ROM 24. Further, connected to the CPU 21 are a clock pulse generator 26 for inputting reference clock pulses (e.g. at a frequency of 4 MHz) to the CPU 21, based on which the CPU 21 operates, and a frequency divider 27 for inputting interruption pulses (e.g. at a frequency of 500 Hz) for enabling an interruption by a predetermined program.

In addition to signals from the above-mentioned switches 8 to 11, signals from a start switch 5S and a coin sensor 6S are supplied via the I/O port 22 to the microcomputer 20, respectively. Further, signals from reel position sensors, not shown, incorporated within reel drivers 15L, 15C and 15R including pulse motors (or stepping motors) for driving the rotating reels 4L, 4C and 4R respectively, and a payout coin sensor 16S for detecting the coins paid out from a coin hopper 16 are inputted via the I/O port 23.

Among the above sensors and switches of the input side, the coin sensor 6S detects proper coins inserted via the coin entry slot 6 of FIG. 1 and selected by a coin selector, not shown, and may be suitably formed by a contact type detector, such as a microswitch, as well as a non-contacting type, such as a magnetic sensor or an optional sensor.

The start switch 5S, which is turned on or off in an interlocked manner with the operation of the lever 5, generates a start signal for starting to drive the reels into rotation when the player has pulled the start lever 5.

The C/P switch 11 is disposed, as described above, at the front face of the gaming machine, and is manually operated for changeover between the credit side and the payout side.

The CPU 21 of the microcomputer 20 receives the input signals from the above various sensors and switches, and stores them as data in the RAM 25.

The microcomputer 20 supplies drive control signals to the pulse motors 15L, 15C and 15R, for control of rotation of the reels 4L, 4C and 4R driven thereby, a payout signal to a driver of the hopper 16 for paying out coins, and a display control signal to a display block drive circuit 17, for control of display of the display block 7 described above.

Next, there will be described operations controlled by the microcomputer 20 of the above-mentioned embodiment.

Figure 3:
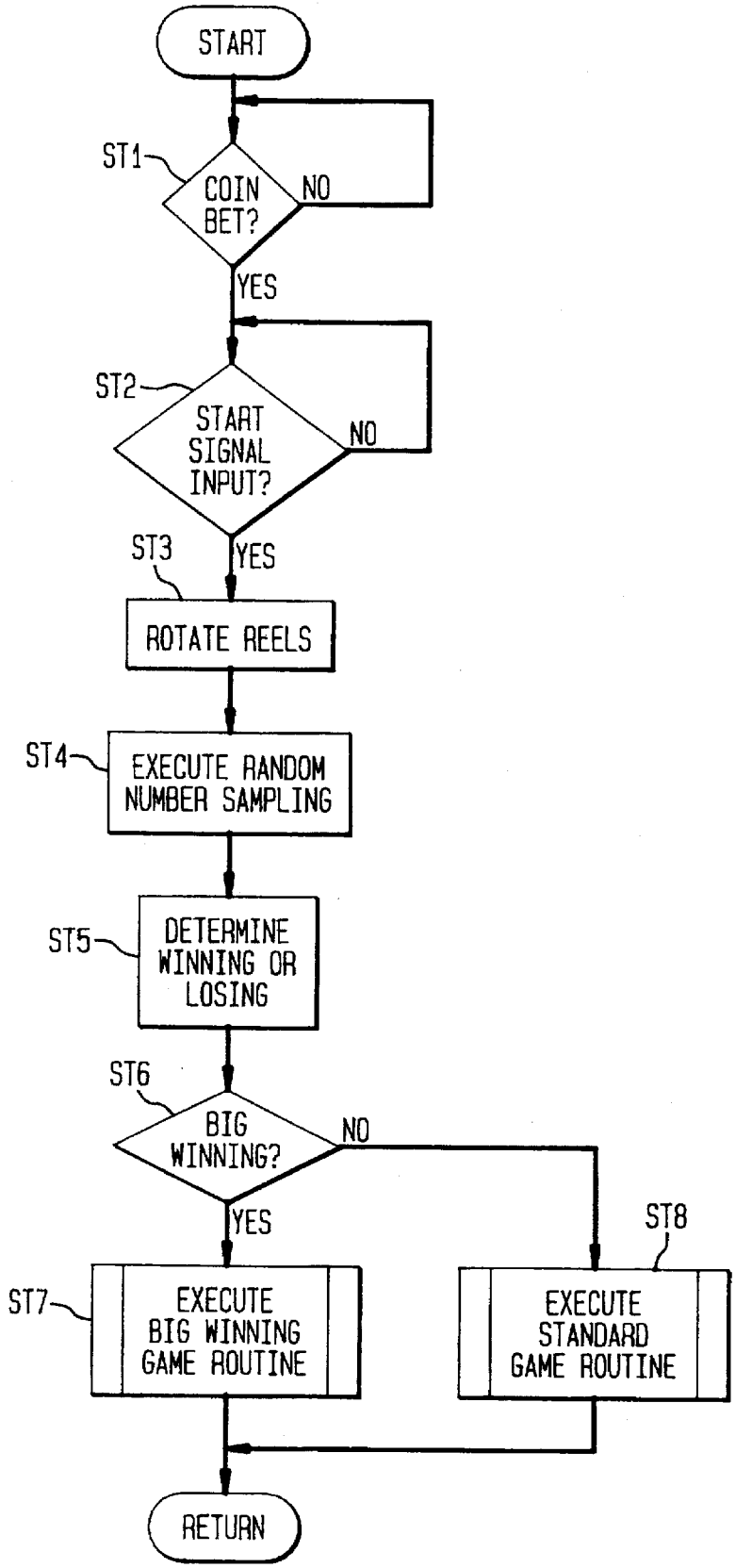
FIG. 3 is a flow chart showing the operations of the embodiment.

Referring to FIG. 3, the CPU 21 determines first whether or not coin BET is executed (at step ST1). The answer to this determination becomes "YES" when the coin is inserted into the coin entry slot 6 and the coin sensor 6S has delivered a detection signal to the CPU 21, or when the bet switch 9 or 10 has delivered a signal to the CPU 21. In that case, next, it is determined whether or not the start switch 5S or the spin switch 8 delivers a signal (the start signal) to the CPU 21 (at step ST2).

If the answer to this question is "YES", the CPU 21 supplies a drive signal to the display block drive circuit 17 to drive the reels 4L, 4C and 4R into rotation (at step ST3), and also executes the random number sampling (at step ST4). The random number sampling is executed by storing a numerical value in the RAM 25 and reading out the numerical value stored in the RAN 25 at each time the interruption operation occurs. The numerical value is obtained by adding a predetermined-number (e.g. "3") to an integer within a predetermined limit (e.g. "0" to "127"), which occurs from a R register in the CPU 21 every time the reference clock pulse is received from the clock pulse generator 26. Further, the numerical value stored in the RAM 25 is updated every time the reference pulse is inputted.

Figure 4:
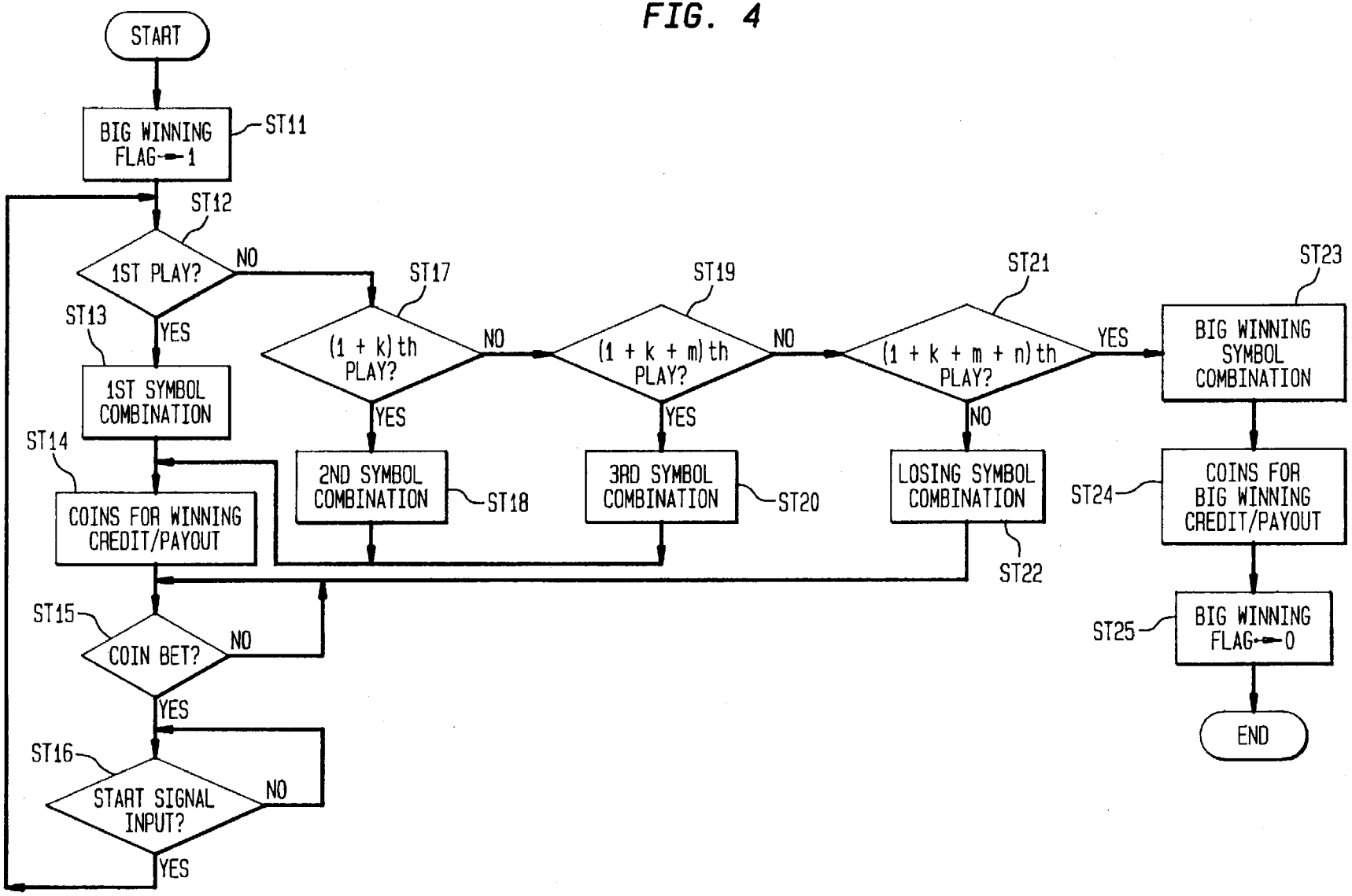
FIG. 4 is a flow chart showing the big winning game routine in the operations of FIG. 3.

Next, the winning determination is executed being based on the random number value sampled as described above (at step ST5). The winning determination is executed by comparing a winning probability table stored in the ROM 24 and the sampled random number value, and a flag (which indicates winning or losing, e.g.) is set in the RAM 25 according to the result of the winning determination. Then, it is determined whether or not the result of the winning determination of this time is the "big winning" (at step ST6). If the answer to the question is "YES", the big winning game routine is executed as shown in FIG. 4 (at step ST7), and if the answer to the question is not the big winning, the standard game routine is executed (at step ST8), then, the operations return to the start.

In the standard game routine, similarly to the case of winning or losing in the conventional slot machines, the variable displays by the above-mentioned rotating reels 4L, 4C and 4R are controlled to stop to be a display pattern according to the result of the winning determination (in this case, winning except "big winning", or "losing"), and the predetermined number of coins are given to the player as the predetermined play value when the determination results in the winning.

Next, the big winning game routine shown in FIG. 4 will be described.

First, a big winning flag is set, that is, a flag indicative of the "big winning" is set as "1" (at step ST11). Next, it is determined whether or not the present play is the first play (at step ST12). Then, in the case of the first play, the variable displays by the rotating reels 4L, 4C and 4R are controlled to stop such that a predetermined first symbol combination (e.g. "stars" 31-"stars" 31-"stars" 31 of FIG. 5) stands on the winning line LN of FIG. 1 (at step ST13), and in proportion to the number of bet coins, the number of coins paid out as awards predetermined like the award table 14 of FIG. 6 is displayed as the credit at the display block 7, or the predetermined number of coins are paid out as awards to the coin tray 13 by driving the hopper 16 (at step ST14).

Next, it is determined whether or not the coin BET is executed (at step ST15). If the answer to the question is "YES", it is determined whether or not the start signal (from the start switch 5S or the spin switch 8) is inputted (at step ST16). If the start signal is inputted, the operations return to the above step ST12 where it is determined whether or not the play is the first play.

If the answer to the question is "NO" (in the case of the play of the second or afterwards), next, it is determined whether or not the present play is the (1+k)th play (at step ST17). Then, if the answer to the question is "YES", the variable displays by the rotating reels 4L, 4C and 4R are controlled to stop such that a predetermined second symbol combination (e.g. "plum" 32-"plum" 32-"plum" 32 of FIG. 5) stands on the winning line LN (at step ST18), and the operations advance to the above step ST14 where the number of coins paid out as awards according to the winning is displayed as the credit at the display block 7, or the coins are paid out as awards to the coin tray 13 by driving the hopper 16, then, the operations advance to the following step ST15.

Here, "k" is a predetermined integral value (except "0"). However, it may be also decided out of the integral values of the predetermined range by executing the random number sampling every one play.

On the other hand, if the answer to the question at the above-mentioned step ST17 is "NO", it is determined whether or not the present play is the (1+k+m)th play (at step ST19). Then, if the answer to the question is "YES", the variable displays by the rotating reels 4L, 4C and 4R are controlled to stop such that a predetermined third symbol combination (e.g. "bells" 33-"bells" 33-"bells" 33 of FIG. 5) stands on the winning line LN (at step ST20), then, the operations advance to the above step ST14 and operate the following similarly.

Here, "m" is a predetermined integral value (except "0"). However, it may be also decided out of the integral values of the predetermined range by executing the random number sampling every one play.

On the other hand, if the answer to the question at the above step ST19 is "NO", it is determined whether or not the present play is the (1+k+m+n)th play (at step ST21). Then, if the answer to the question is "NO", the variable displays by the rotating reels 4L, 4C and 4R are controlled to stop such that a predetermined "losing" symbol combination (e.g. "bells" 33-"orange" 34-"plum" 32 of FIG. 5) stands on the winning line LN (at step ST22). In this case, the awards do not occur (the coins are not paid out), then, the operations advance to the above step ST15.

At the above step ST21, if the present play is determined as the (1+k+m+n)th play, the variable displays by the rotating reels 4L, 4C and 4R are controlled to stop such that the predetermined "big winning" symbol combination (e.g. "7"-"7"-"7" of FIG. 5) stands on the winning line LN (at step ST23). And the predetermined number of coins paid out as awards is displayed as the credit at the display block 7, or the coins are paid out to the coin tray 13 by driving the hopper 16 (at step ST24), then, the above-mentioned big winning flag is reset as "0" (at step ST25) and this routine is over.

Here, "n" is a predetermined integral value (except "0"). However, it may be also decided out of the integral values of the predetermined range by executing the random number sampling every one play.

As described above, according to the big winning game routine of the embodiment, after the big winning flag is set, the game is executed in the following order:

The first symbol combination play is executed once.
→The "losing" plays are executed (k–1) times.
→The second symbol combination play is executed once.
→The "losing" plays are executed (m–1) times.
→The third symbol combination play is executed once.
→The "losing" plays are executed (n–1) times.
→The "big winning" play is executed once.

Accordingly, if it is informed the player with an explanation or the like of the gaming machine that the big winning play will certainly occur after the symbol combination plays of the first, second and third occur in the above-mentioned order, when the first symbol combination play occurs, the player expects that the second symbol combination play will occur next, and when the second symbol combination play occurs, the player continues playing the game expecting that the third symbol combination play will occur next and furthermore expecting that the "big winning" will occur. Thus, the player comes to play the game with much interest larger than the prior art.

Particularly, if the integral values "k", "m" and "n" for determining the number of the "losing" plays executed among the first, second and third symbol combination plays are not set in advance as above but are decided by the random number sampling every time after each of these three symbol combination plays is over, then the three symbol combination plays will occur at irregular intervals and the game will become more interesting.

In addition, in the big winning game routine of the above-mentioned embodiment, after the big winning flag is set, the first, second and third symbol combination plays and the "big winning" symbol combination play are to be executed in the form including the "losing" plays among those plays. However, instead of executing the plays in such form, the first, second and third symbol combinations and the "big winning" symbol combination may be displayed in order during one game after the coin BET (the "losing" plays are omitted).

Figure 7:
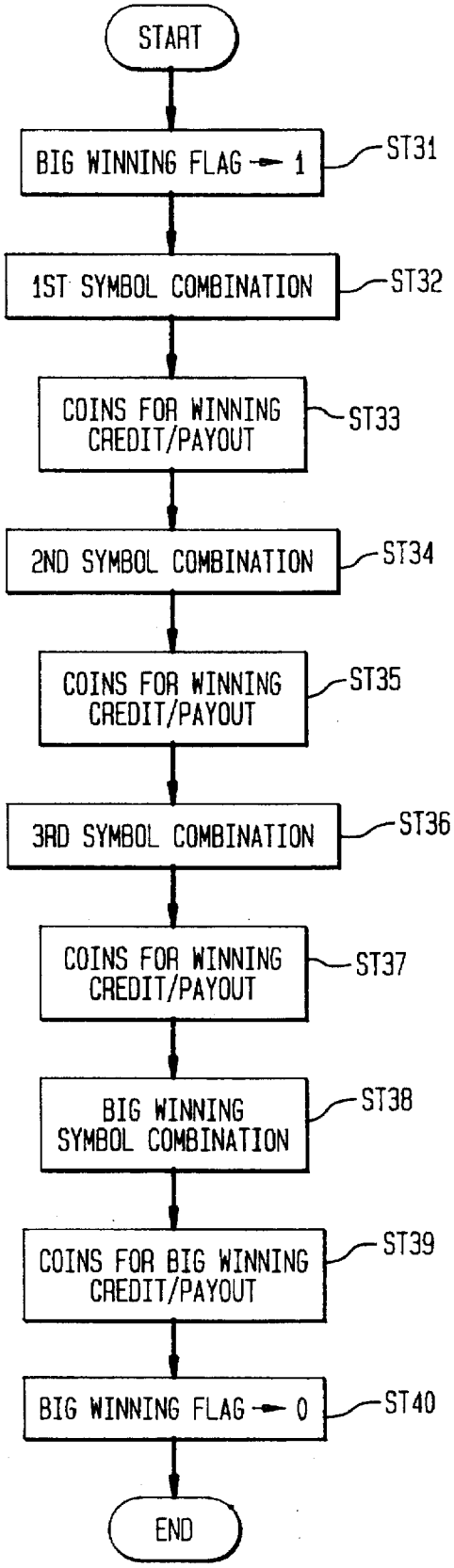
FIG. 7 is a flow chart showing another example of the big winning game routine.

In other words, first, the big winning flag is set as shown in FIG. 7 (at step ST31), next, the first symbol combination is displayed in the similar way to the step ST18 of FIG. 4 (at step ST32), and the predetermined number of coins paid out as awards is displayed as the credit, or the coins are paid out as awards similarly to the step ST14 of FIG. 4 (at step ST33). Then, the second symbol combination is displayed similarly (at step ST34), and also the predetermined number of coins paid out as awards for this combination is displayed as the credit, or the coins are paid out as awards (at step ST35). Furthermore, the third symbol combination is displayed (at step ST36), and also the predetermined number of coins paid out as awards for this combination is displayed as the credit, or the coins are paid out as awards (at step ST37). Then, the above "big winning" symbol combination is displayed finally (at step ST38), and also the predetermined number of coins paid out as awards for the combination is displayed as the credit, or the coins are paid out as awards (at step ST39), and the above-mentioned big winning flag is reset (at step ST40). One game is over in such a form.

In the above-mentioned embodiment, though the awards will occur in all of the first to third symbol combination plays, it is acceptable that no awards will occur.

Further, though the above-mentioned embodiment is the slot machine employing the rotating reels as the variable display device, not only a rotating reel mechanism but also electrical display means such as the LCD, the LED's, the CRT and the like can be employed. In addition, the invention may be applied similarly to the ball-shooting game machine having the variable display block employing the rotating reels, the LCD, the LED's or the CRT.

What is claimed is:

1. A gaming .machine comprising:

a variable display device for variably displaying a plurality of display patterns so as to give a predetermined play value according to display pattern at the time when variable displays stop; and control means for driving said variable display device, executing a winning determination and controlling said variable displays of said variable display device to stop so as to be said display patterns of winning or losing according to a result of said determination, when a predetermined play condition is satisfied; which is characterized in that said control means executes a winning game routine that comprises a predetermined winning, and controls said variable displays of said variable display device to stop said winning game routine comprising a plurality of predetermined display patterns and a winning pattern, said control means executing said winning game routine by driving and stopping said variable display device to display a predetermined display pattern recognizable by a player as one of said plurality of said predetermined display patterns, and said predetermined display pattern indicating to the player that said gaming machine is executing said winning game routine with the expectation that said winning pattern will soon occur, said control means continuing the execution of said winning game routine, by repeatedly driving and stopping said variable display device until all of said plurality of predetermined display patterns are displayed as results of said desired times of plays, then said control means controls said variable displays of said variable display device to stop such that said winning pattern which a player can distinguish as said particular winning is displayed.

2. A gaming machine according to claim 1, in which said desired times of plays include a plurality of predetermined symbol combination plays and a symbol combination play which displays said particular winning after said plurality of symbol combination plays are executed.

3. A gaming machine according to claim 2, in which desired times of losing plays are executed among each of said plurality of symbol combination plays and said symbol combination play which displays said particular winning.

* * * * *